US012416216B2

(12) United States Patent
Patel et al.

(10) Patent No.: US 12,416,216 B2
(45) Date of Patent: Sep. 16, 2025

(54) SYSTEM AND METHODOLOGY FOR BYPASSING THROUGH AN EXPANDABLE METAL PACKER

(71) Applicant: SCHLUMBERGER TECHNOLOGY CORPORATION, Sugar Land, TX (US)

(72) Inventors: Dinesh R. Patel, Humble, TX (US); Samuel Roselier, Bruz (FR); Romain Neveu, Bruz (FR); Robin Laupie, Bruz (FR); Louis Bazin, Bruz (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/698,285

(22) PCT Filed: Oct. 25, 2022

(86) PCT No.: PCT/US2022/047653

§ 371 (c)(1),
(2) Date: Apr. 3, 2024

(87) PCT Pub. No.: WO2023/076215

PCT Pub. Date: May 4, 2023

(65) Prior Publication Data

US 2025/0059848 A1 Feb. 20, 2025

Related U.S. Application Data

(60) Provisional application No. 63/273,493, filed on Oct. 29, 2021.

(51) Int. Cl.

| | |
|---|---|
| ***E21B 33/127*** | (2006.01) |
| ***E21B 17/18*** | (2006.01) |
| ***E21B 23/06*** | (2006.01) |

(52) U.S. Cl.
CPC ..... *E21B 33/127* (2013.01); *E21B 17/18* (2013.01); *E21B 23/06* (2013.01)

(58) Field of Classification Search
CPC ..... E21B 17/18; E21B 33/127; E21B 33/128; E21B 23/06; E21B 34/06; E21B 34/08; E21B 17/00; E21B 21/10
See application file for complete search history.

(56) References Cited

U.S. PATENT DOCUMENTS 4,260,164 A * 4/1981 Baker ..... E21B 33/127 137/461
4,776,396 A * 10/1988 Studholme ..... E21B 33/1246 166/187

(Continued)

FOREIGN PATENT DOCUMENTS

| | | |
|---|---|---|
| EP | 3266977 A1 | 1/2018 |
| WO | 2016065235 A1 | 4/2016 |
| WO | 2018007483 A1 | 1/2018 |

*Primary Examiner* — Yong-Suk (Philip) Ro
(74) *Attorney, Agent, or Firm* — Jeffrey D. Frantz

(57) ABSTRACT

A technique facilitates improved actuation and use of packers which may be disposed along a well string placed in a borehole, e.g. a wellbore. Each packer may be constructed with a tubing, sometimes referred to as a mandrel, and an expandable metal bladder secured around the tubing via connections. The packer may further comprise a sealing element mounted about the expandable metal bladder. The packer also comprises couplings, e.g. a first coupling and a second coupling, connected at opposite ends of the tubing. The couplings each having a hole therethrough to provide a feedthrough running from an exterior to an interior of the tubing at both ends of the tubing.

18 Claims, 3 Drawing Sheets

(56) References Cited

U.S. PATENT DOCUMENTS

| | | | | |
|---|---|---|---|---|
| 5,875,852 | A | 3/1999 | Floyd | |
| 6,220,362 | B1 | 4/2001 | Roth | |
| 6,325,144 | B1 | 12/2001 | Turley | |
| 10,677,013 | B2 | 6/2020 | Hazel | |
| 2006/0042801 | A1 | 3/2006 | Hackworth | |
| 2020/0362660 | A1* | 11/2020 | Mani | E21B 33/1208 |
| 2024/0328279 | A1 | 10/2024 | Roselier | |

* cited by examiner

SYSTEM AND METHODOLOGY FOR BYPASSING THROUGH AN EXPANDABLE METAL PACKER

CROSS REFERENCE TO RELATED APPLICATIONS

This application is a national stage entry under 35 U.S.C. 371 of International Application No. PCT/US2022/047653, filed Oct. 25, 2022 which claims the benefit of U.S. Provisional Application No. 63/273,493 entitled "System and Methodology for Bypassing Through an Expandable Metal Packer," filed Oct. 29, 2021, the disclosure of which is incorporated by reference in its entirety.

BACKGROUND

In many oil and gas well applications, a wellbore is drilled into the earth and through a reservoir of a desired fluid, e.g. oil and/or gas. The wellbore may subsequently be completed with appropriate completion equipment having packers which may be expanded to isolate regions along the wellbore. For example, packers may be disposed along sand control equipment or other types of completion equipment to facilitate production of the desired fluids from the reservoir. Depending on the application, the packers may be mounted along a well string and selectively expanded to effectively form a seal between production tubing of the well string and the surrounding wellbore wall. In some applications, the completion equipment may comprise alternate path systems, control lines, and/or other components which extend down along the production tubing. However, routing such components through existing packer designs while maintaining desired packer functionality can be expensive and/or problematic.

SUMMARY

In general, a system and methodology facilitate improved actuation and use of packers disposed along a well string and placed in a borehole, e.g. a wellbore. Each packer may comprise a tubing, sometimes referred to as a mandrel, and an expandable metal bladder secured around the tubing via connections. The packer may further comprise a sealing element mounted about the expandable metal bladder. The packer further comprises couplings, e.g. a first coupling and a second coupling, connected at opposite ends of the tubing. The couplings each have at least one hole therethrough to provide a feedthrough running from an exterior to an interior of the tubing. This allows a component to be fed from an exterior of the packer through the hole of one coupling; along an interior of the tubing; and out to the exterior of the packer through the hole of the other coupling. The component may comprise various types of control lines, e.g. hydraulic, electric, optical fiber; alternate path tubes; or other components which bypass the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate improved actuation and use of packers disposed in a wellbore or other type of borehole. According to an embodiment, the packer may be constructed with a tubing, sometimes referred to as a mandrel, and an expandable metal bladder secured around the tubing via connections. The packer may further comprise a sealing element mounted about the expandable metal bladder. The packer further comprises couplings, e.g. a first coupling and a second coupling, connected at opposite ends of the tubing. The couplings each have at least one hole therethrough to provide a feedthrough running from an exterior to an interior of the tubing at both ends of the tubing. This allows a component to be fed from an exterior of the packer through the hole of one coupling; along an interior of the tubing; and out to the exterior of the packer through the hole of the other coupling. The component may comprise various types of control lines, e.g. hydraulic, electric, optical fiber; alternate path tubes; or other components which bypass the packer.

An individual packer or a plurality of packers may be disposed along a well string to enable isolation of zones/regions along the wellbore or other type of borehole. For example, a plurality of the packers may be disposed along a well string having a downhole completion comprising sand control equipment. The packers enable isolation of well zones from which a production fluid, e.g. oil and/or gas, is received and produced to a desired collection location. Once positioned downhole, the packer or packers may be actuated by expanding the expandable metal bladder to drive the sealing element into sealing engagement with the surrounding borehole wall. The expandable metal bladder may be expanded and plastically deformed via application of sufficient pressure along its interior. For example, the expandable metal bladder may be expanded via hydroforming by directing fluid under pressure down through an interior of the well string and to an interior of the expandable metal bladder.

The packer described herein provides an innovative arrangement for placing feedthrough lines or other feedthrough components through the packer. Effectively, the structure enables a bypass through the length of the packer so the lines or other components are able to easily bypass the packer without affecting operation of the packer.

Figure 1:
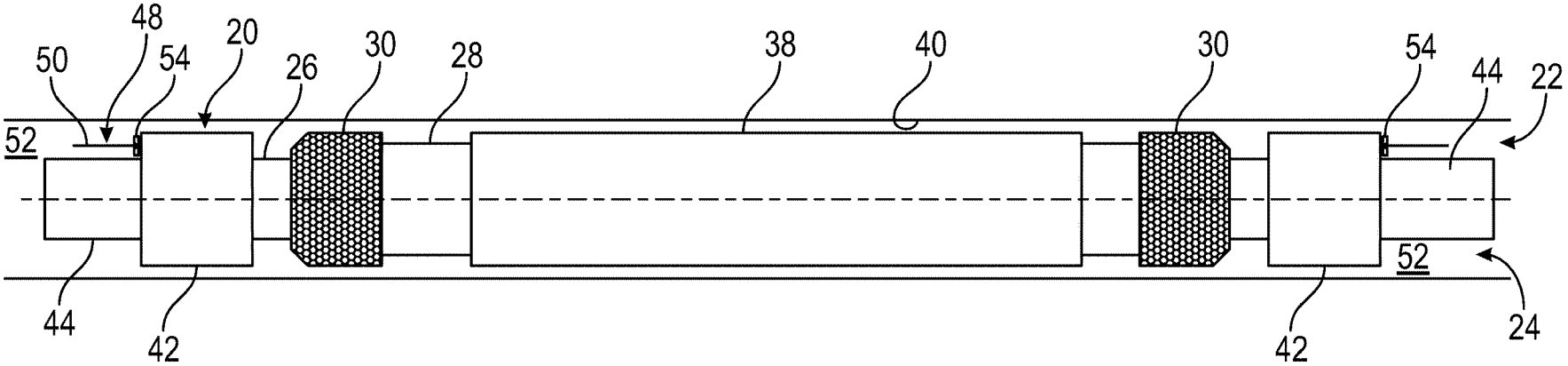
FIG. 1 is an illustration of an example of a packer utilizing an expandable metal bladder and at least one feedthrough, according to an embodiment of the disclosure.

Referring generally to FIG. 1, an example of a packer 20 is illustrated as positioned along a well string 22 within a borehole 24, e.g. a wellbore. In this example, the packer 20 is in the form of an expandable metal packer having a tubing 26, sometimes referred to as a mandrel. An expandable metal bladder 28 is secured along the tubing 26 and secured around the tubing 26 via suitable connections 30. The connections 30 may be in the form of end connections, as illustrated, coupled to opposite ends of the expandable metal bladder 28.

The connections 30 may be sealingly secured to the expandable metal bladder 28 and to the tubing 26 via welding, crimping, using seals and locking mechanisms, or via other suitable connection techniques. The sealed engagement effectively forms a packer chamber 32 which is an internal cavity between the expandable metal bladder 28 and the tubing 26, as further illustrated in FIGS. 2 and 3. The expandable metal bladder 28 may be selectively expanded via pressurized fluid delivered down through an internal passage 34 of the well string 22/tubing 26 and directed to packer chamber 32 via a suitable lateral expansion port or ports 36 extending laterally through tubing 26 as illustrated. In some embodiments, flow through port(s) 36 may be controlled by a valve or other flow control device.

A sealing element 38, e.g. an elastomeric sealing element, may be adhered or otherwise secured about the expandable metal bladder 28. The sealing element 38 is positioned to move into sealing engagement with a surrounding borehole wall 40 defining borehole 24. When the expandable metal bladder 28 is sufficiently expanded via application of suitable internal pressure, the expandable metal bladder 28 is caused to expand and plastically deform so as to securely force the sealing element 38 against borehole wall 40.

Figure 2:
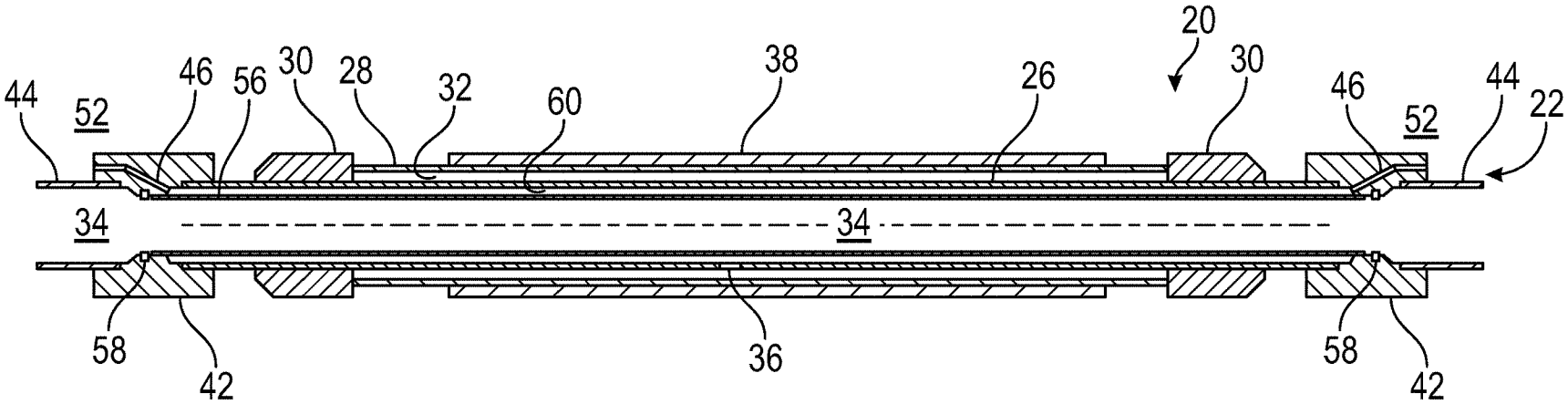
FIG. 2 is a cross-sectional illustration of the packer shown in FIG. 1 without a bypass component, according to an embodiment of the disclosure.
Figure 3:
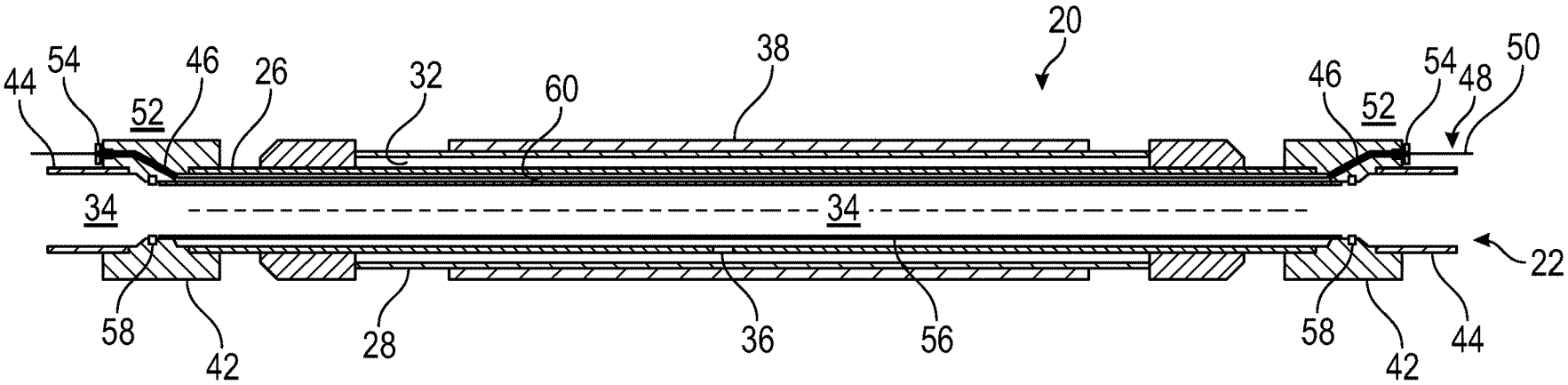
FIG. 3 is a cross-sectional illustration of the packer shown in FIG. 1 with a bypass component extending therethrough, according to an embodiment of the disclosure.

With additional reference to FIGS. 1-3, the expandable metal packer 20 also comprises couplings 42 connected to the tubing 26. For example, the couplings 42 may comprise first and second couplings connected to first and second (opposite) ends of the tubing 26. The couplings 42 may be connected to tubing 26 via suitable threaded connections, welding, crimping, using seals and locking mechanisms, or via other suitable connection techniques. In some embodiments, the tubing 26 and the first and second couplings 42 may be formed as a unitary, single part.

The couplings 42 also may be connected with corresponding uphole and downhole tubing sections 44 which form part of the overall well string 22. In this manner, the packer 20 may be coupled into well string 22 via threaded connection or other suitable connection between the corresponding couplings 42 and tubing sections 44. It should be noted that in some embodiments, the tubing 26 and the tubing sections 44 may have the same diameter, e.g. the same interior diameter.

Additionally, each coupling 42 comprises a hole 46 or a plurality of holes 46 arranged to help provide a packer bypass for a well component 48, e.g. a control line or other bypass line 50, as illustrated in FIG. 3. Each control line 50 may comprise a hydraulic control line, an electric control line, an optical fiber control line, or another type of control line routed so as to bypass packer 20.

In some embodiments, a plurality of control lines 50 may be routed to bypass packer 20. The plurality of control lines 50 may comprise similar or dissimilar control lines. For example, the control lines 50 bypassing packer 20 may include various combinations of hydraulic, electric, and/or optical fiber control lines. Additionally, a plurality of similar or dissimilar components 48/control lines 50 may be routed through separate dedicated holes 46 in each coupling 42. In other embodiments, however, groups of two or more components 48/control lines 50 may be routed collectively through sufficiently large individual holes 46 in each coupling 42.

The hole or holes 46 in each coupling 42 may be drilled or otherwise formed to create a passage between an exterior 52 of the packer 20/tubing 26 and the internal passage 34 of tubing 26. This allows the component(s) 48, e.g. control line(s) 50, to bypass the packer 20 along an interior of the tubing 26 between the two couplings 42. The control lines 50 (or other components) may be sealed to each coupling 42 at the corresponding hole or holes 46 via a sealing connector 54, e.g. a dry mate connector or other suitable sealing connector.

In some embodiments, a protection tube 56 may be placed inside the tubing 26 and connected to an interior region of the couplings 42. The protection tube 56 may be connected at its opposite ends to couplings 42 via a locking element 58 which may be in the form of an abutment, lock ring, weldment, or other suitable element to hold protection tube 56 to both couplings 42 within the surrounding tubing 26.

The protection tube 56 engages the couplings 42 on opposite side of the hole(s) 46 relative to tubing 26. This arrangement effectively creates a protected passage 60 between the tubing 26 and the protection tube 56. As illustrated, the protected passage 60 may be an annular space located radially between the tubing 26 and protection tube 56. The protected passage 60 is sized to accommodate passage/bypass of control lines 50 or other components 48. As illustrated in FIG. 3, a given control line 50 (or other component 48) is routed from an exterior 52; through hole 46 of the first coupling 42; along the interior of tubing 26; and then out through hole 46 of the second coupling 42 so as to effectively bypass the packer 20. If protection tube 56 is used, the given control line 50 (or other component 48) is routed along the interior of tubing 26 in the protected passage 60 between tubing 26 and protection tube 56.

Figure 4:
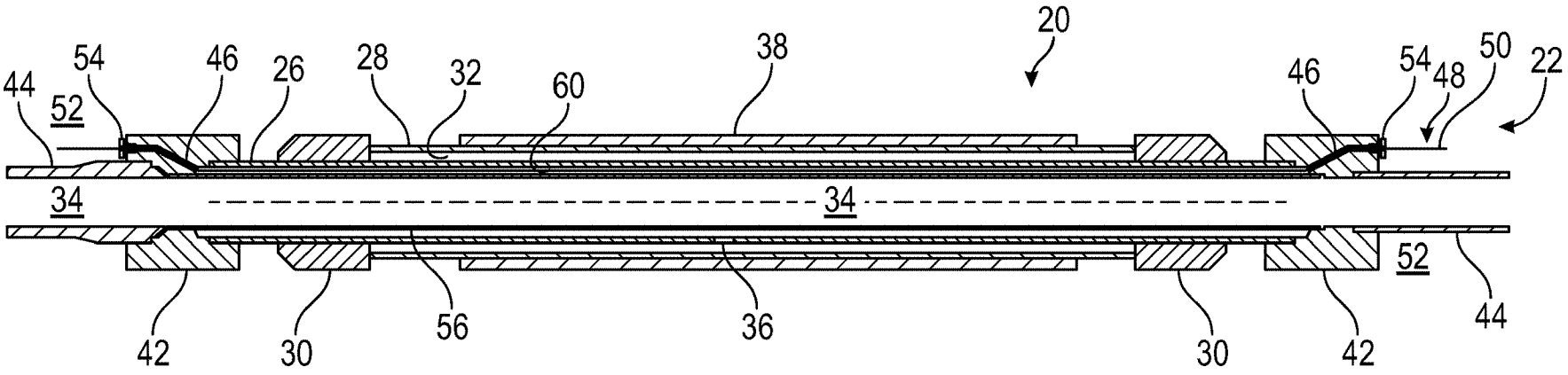
FIG. 4 is a cross-sectional illustration of another example of a packer having at least one feedthrough, according to an embodiment of the disclosure.

Referring generally to FIG. 4, another embodiment of packer 20 is illustrated. In this example, the tubing 26 and the tubing sections 44 have different diameters, e.g. different interior diameters. In the illustrated embodiment, tubing 26 has a larger interior diameter than that of tubing sections 44. The couplings 42 are constructed to receive the larger diameter tubing 26 on the inner side of packer 20 and to receive the smaller diameter tubing sections 44 on the outer side of packer 20.

Depending on the parameters of a given operation and the environment in which such operation is conducted, the components of packer 20 may be made from a variety of materials and in a variety of configurations. For example, the tubing 26 and couplings 42 may be made as a unitary component or as separate components which are connected together. Various numbers of holes/passages 46 may be constructed in various sizes and arrangements through each of the couplings 42 to accommodate the bypass functionality. The tubing 26 and corresponding tubing sections 44 of well string 22 may be formed with various diameters which are common or dissimilar. Also, the expandable metal bladder 28 and sealing element 38 may be constructed from a variety of materials and in a variety of sizes and configurations. Different types of connection techniques also may be utilized for connecting the packer components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a packer sized for placement along a well string to enable formation of a seal at a desired location in a borehole, the packer comprising:

a tubing including a bore;

an expandable metal bladder;

a first end connection disposed about the tubing coupling a first end of the expandable metal bladder to the tubing;

a second end connection disposed about the tubing and coupling a second end of the expandable metal bladder to the tubing;

a sealing element mounted around the expandable metal bladder and positioned to move into sealing engagement with a surrounding borehole wall when the expandable metal bladder is sufficiently expanded via internal pressure;

a first coupling partially disposed about the tubing and connected to a first end of the tubing and axially spaced from the first end connection, wherein the first coupling includes:

an annular body forming a bore in fluid communication with the bore of the tubing; and a hole formed in the annular body to provide a feedthrough running from an exterior of the first coupling to the bore of the first coupling;

a second coupling partially disposed about the tubing and connected to a second end of the tubing and axially spaced from the second end connection, the second coupling includes:

an annular body forming a bore in fluid communication with the bore of the tubing; and a hole formed in the annular body to provide a feedthrough running from an exterior of the second coupling to the bore of the second coupling; and a protection tubular disposed inside of the tubing and coupled to an interior region of the first coupling and the second coupling.

2. The system as recited in claim 1, further comprising a bypass line routed along an interior of the tubing and out to an exterior of the tubing through the hole in the first coupling and the hole in the second coupling.

3. The system as recited in claim 2, wherein each coupling comprises a sealing connector position to form a seal between the bypass line and the coupling.

4. The system as recited in claim 2, wherein the bypass line comprises a plurality of bypass lines.

5. The system as recited in claim 2, wherein the bypass line comprises a hydraulic line.

6. The system as recited in claim 2, wherein the bypass line comprises an electric line.

7. The system as recited in claim 2, wherein the bypass line comprises a fiber optic line.

8. The system as recited in claim 2, wherein the bypass line comprises a combination of different bypass lines.

9. The system as recited in claim 1, wherein the first coupling and the second coupling are each connected to the tubing via threaded connections.

10. The system as recited in claim 1, wherein the first coupling and the second coupling are formed as a unitary part with the tubing.

11. The system as recited in claim 1, wherein the packer is connected into a well string via the first and second couplings.

12. The system as recited in claim 11, wherein the well string comprises tubing sections having the same diameter as the tubing.

13. The system as recited in claim 11, wherein the well string comprises tubing sections having a different diameter than the tubing.

14. The system as recited in claim 1, wherein the tubing comprises an expansion port extending from an interior of the tubing to a packer chamber between the tubing and the expandable metal bladder.

15. The system as recited in claim 14, wherein flow through the expansion port is controlled by a valve.

16. The system as recited in claim 1, wherein the interior region of the first coupling includes the bore of the first coupling, and wherein the interior region of the second coupling includes the bore of the second coupling.

17. The system as recited in claim 1, wherein:

the hole of the first coupling runs from the exterior of the first coupling to an annulus formed by the bore of the first coupling and the protection tubular; and the hole of the second coupling runs from the exterior of the second coupling to an annulus formed by the bore of the second coupling and the protection tubular.

18. The system as recited in claim 11, wherein the well string includes a first tubular coupled to the first coupling and a second tubular coupled to the second coupling, and wherein the hole of the first coupling provides a feedthrough from an exterior of the first tubular to the bore of the tubing and the hole of the second coupling provides a feedthrough from an exterior of the second tubular to the bore of the tubing.

* * * * *